United States Patent [19]

Deimen

[11] Patent Number: 4,633,639

[45] Date of Patent: Jan. 6, 1987

[54] CONSTRUCTION BLOCK

[76] Inventor: Michael L. Deimen, 11695 Oak Hill, Pinckney, Mich. 48169

[21] Appl. No.: 557,888

[22] Filed: Dec. 5, 1983

[51] Int. Cl.[4] ..... E04C 1/10; E04C 1/30

[52] U.S. Cl. ..... 52/590; 52/593; 52/604; 52/608; 52/609; 446/124

[58] Field of Search ..... 52/590, 593, 608, 609, 52/604, 561, 436; 446/124

[56] References Cited

U.S. PATENT DOCUMENTS

| | | | |
|---|---|---|---|
| D. 277,609 | 2/1985 | Deimen | D25/80 |
| 784,476 | 3/1905 | Davis | 52/604 X |
| 3,678,613 | 7/1972 | Geymeier | 446/124 |
| 3,838,535 | 10/1974 | Larus | 446/124 |
| 3,919,785 | 11/1975 | Generaux | 446/124 X |
| 4,381,619 | 5/1983 | Griffin | 52/590 |

FOREIGN PATENT DOCUMENTS

| | | | |
|---|---|---|---|
| 54796 | 5/1938 | Denmark | 52/604 |
| 904106 | 2/1945 | France | 52/593 |
| 928716 | 10/1956 | France | 52/561 |

*Primary Examiner*—Alfred C. Perham
*Attorney, Agent, or Firm*—James M. Deimen

[57] ABSTRACT

A modular construction block comprising a configuration built up from five indentical rectangular sub-blocks dimensioned in the ratio of 1:2:4 and assembled into an "H"-shaped symmetric block about either of two vertical perpendicular planes through the center of the block.

The assemblage provides an "H"-shaped block wherein all external dimensions, slots and recesses are integer multiples of the minimum sub-block dimension. The blocks can be assembled together in a very wide variety of combinations to create utilitarian or decorative structures. The blocks may be sized for toy construction sets or for full sized building projects. The blocks may be formed of wood, plastic, metal, concrete or ceramic depending upon size and use.

16 Claims, 9 Drawing Figures

CONSTRUCTION BLOCK

BACKGROUND OF THE INVENTION

The field of the invention pertains to construction or building blocks of modular form for either toy construction sets or full scale building projects. More particularly, the invention pertains to modular blocks that may be assembled to create aesthetically pleasing structues that may or may not be utilitarian in purpose.

The prior art comprises the gamut of building blocks from the small rectangular and square parallelepiped wood blocks for pre-school childern to modular concrete and ceramic blocks for building construction. Typical of the latter are concrete or cinder blocks and hollow structural tiles. Tiles in particular have been formed in a variety of decorative shapes since the dawn of history. Concrete blocks more recently have been formed with decorative shapes, however, the decorative shapes and designs are normally separate and unrelated to the portions of the blocks that abut adjacent blocks to form a structure.

SUMMARY OF THE INVENTION

The invention comprises a modular construction block of a configuration built up from five identical rectangular sub-blocks dimensioned in the ratio of 1:2:4. The sub-blocks are assembled into an integral "H"-shape symmetric about either of two vertical perpendicular planes through the vertical centerline of the block. The blocks, however, are not required to be placed with one specific orientation but rather may be placed as required by the specific assemblage of blocks desired for a particular aesthetic effect.

There is provided an "H"-shaped block wherein all external dimensions, slots and recesses are integer multiples of the minimum sub-block dimension. As formed, the blocks are of integral one piece construction. The blocks can be assembled together in a very wide variety of combinations to create utilitarian or decorative structures. The blocks may be sized for toy construction sets or for full sized building projects. Wood, plastic, metal, concrete or ceramic may be utilized for the blocks.

The integer multiple dimensioning of the blocks including the recesses and slots permits assembly of the blocks into a wide variety of repeating or random non-repeating patterns limited only by the imagination of the designer of the structure. An individual block may be fitted to or positively engaged with abutting blocks on any one or more of all six sides of the block.

With a press or interference fit between the "studs" and "sockets" of the blocks completely self supporting structures can be created. With such a fit the blocks can be interconnected in such a manner as to interweave or interlock the blocks together without extended planar joints therebetween. However, where a simple column is desired, such a straight column can be created with the blocks.

DESCRIPTION OF THE PREFERRED EMBODIMENTS

FIGS. 1 through 5 illustrate the basic configuration of the construction block. The block is substantially "H"-shaped (two vertical portions joined by a horizontal central portion) and may be of any convenient size whether for a toy building set or as a full size building construction block. The blocks may be made of any convenient or suitable material depending upon the use of the blocks. As a toy, wood or plastic is suitable. As a full sized construction block, brick, concrete, tile, metal, plastic, glass or wood may be suitable, depending upon the circumstances.

As a mass produced item, the blocks are preferably formed as an integral cast or molded unit that may be solid or hollow. Individual blocks can be built up from separate pieces, preferably by assembling five equal rectangular parallelepipeds with dimensions specified by the proportions 1:2:4. The dotted lines 11 indicate the planes separating the five rectangular parallelepipeds that form a block.

Figure 1:
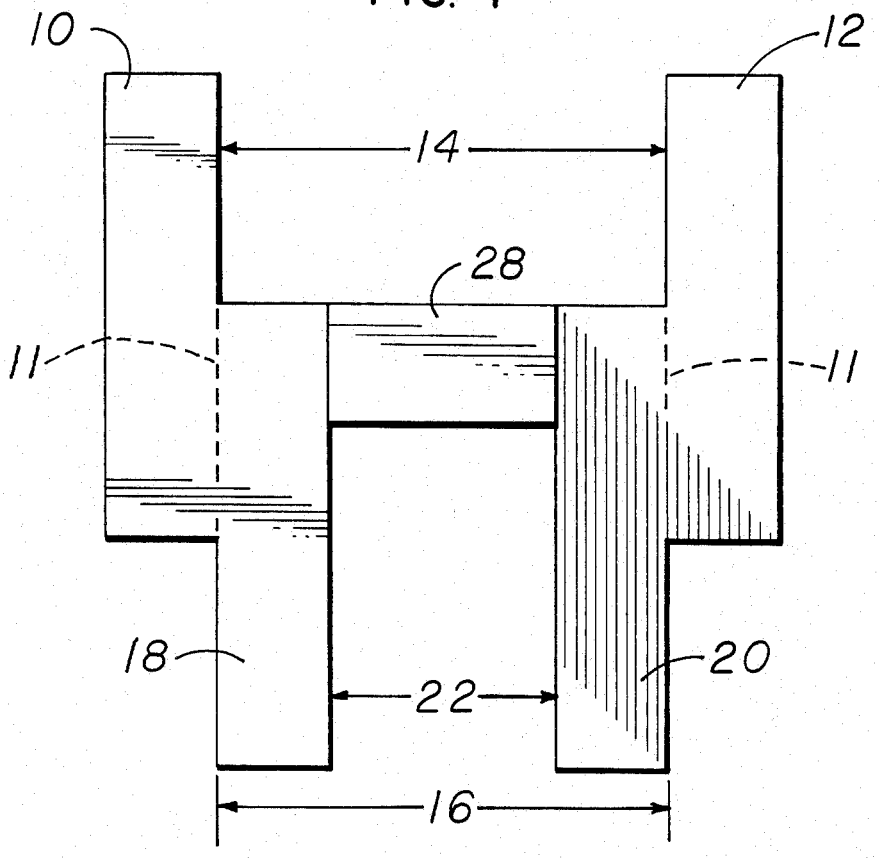
FIG. 1 is a side view of the construction block.
Figure 2:
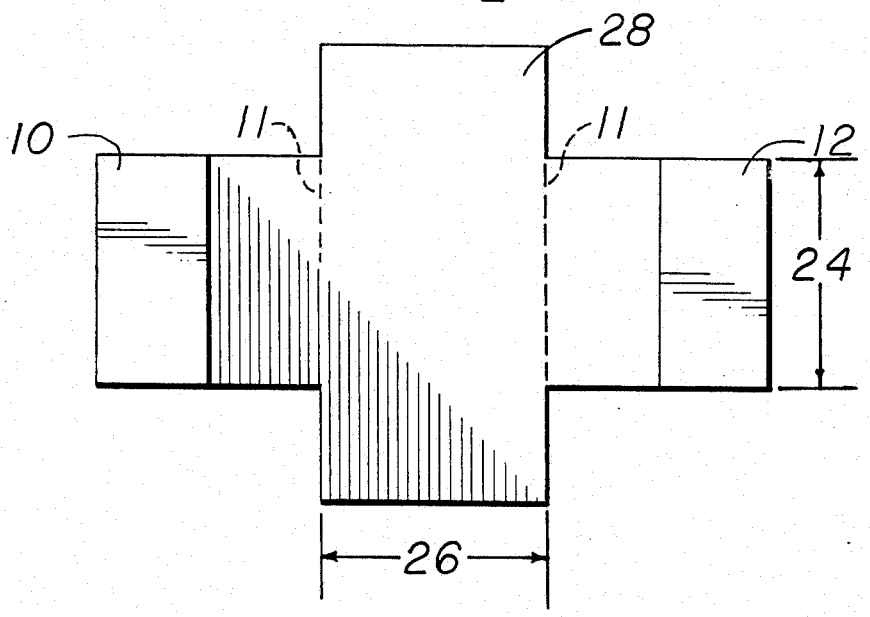
FIG. 2 is a top view of the construction block.
Figure 3:
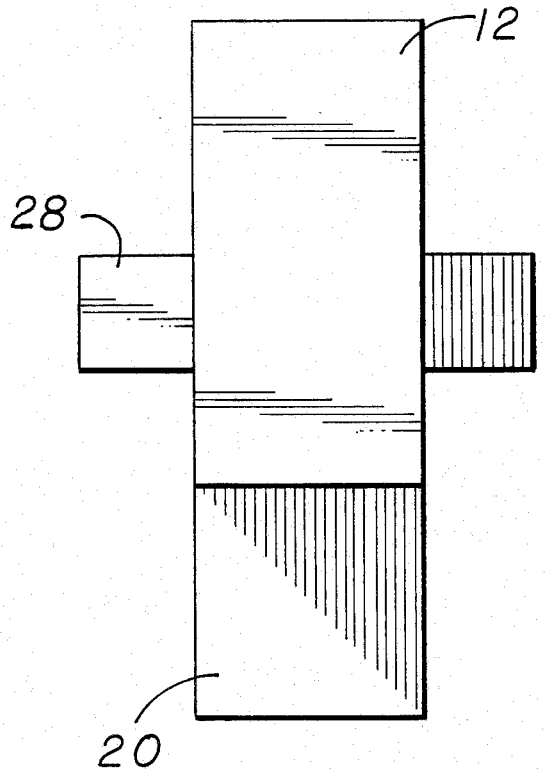
FIG. 3 is an end view of the construction block.
Figure 4:
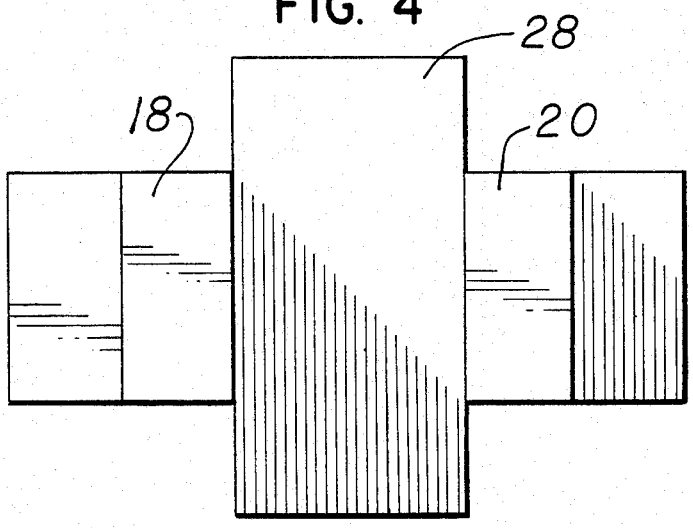
FIG. 4 is a bottom view of the construction block.
Figure 5:
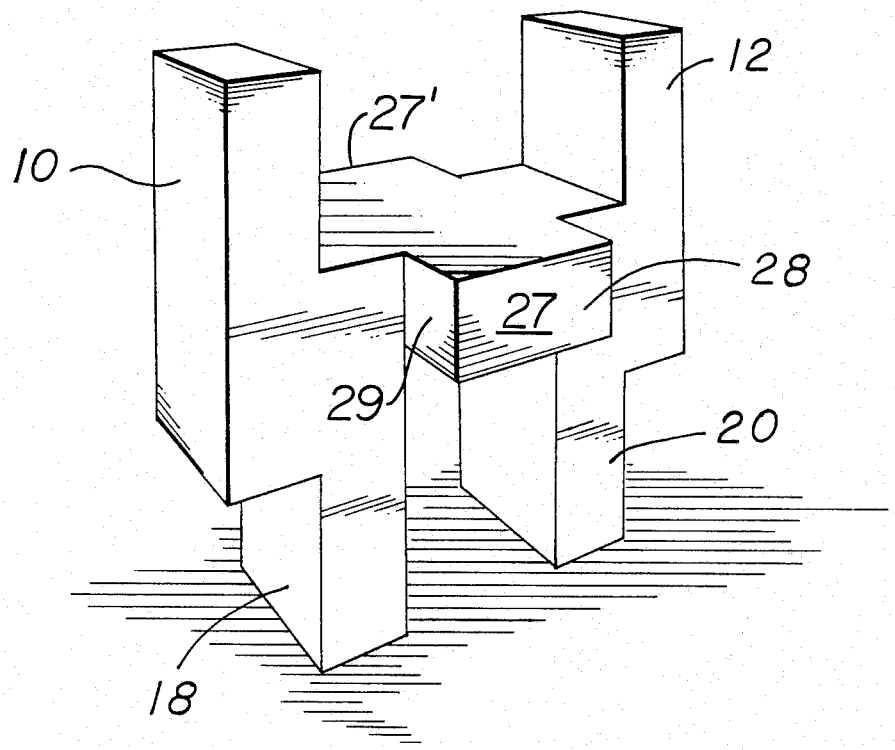
FIG. 5 is a perspective view of a single construction block.

In FIG. 1 and outside legs 10 and 12 are spaced apart a distance therebetween 14 equal to outside dimension 16 of the inside legs 18 and 20. The distance 22 in FIG. 1 between the inside legs 18 and 20 is equal to the outside dimensions 24 (the depth of the legs) and 26 (cross-piece 28 width) as shown in FIG. 2. The thickness of each leg 10,12,18 and 20 and the thickness of the cross-piece or central portion 28 is the minimum dimension of the block. All other dimensions are related in the 1:2:4 proportion to the minimum dimension.

The central portion 28 includes a shorter vertical side 27 and a longer vertical side 29, the longer vertical side extending through the block to the shorter vertical side 27' at the opposite end of the horizontal central portion 28.

Figure 6:
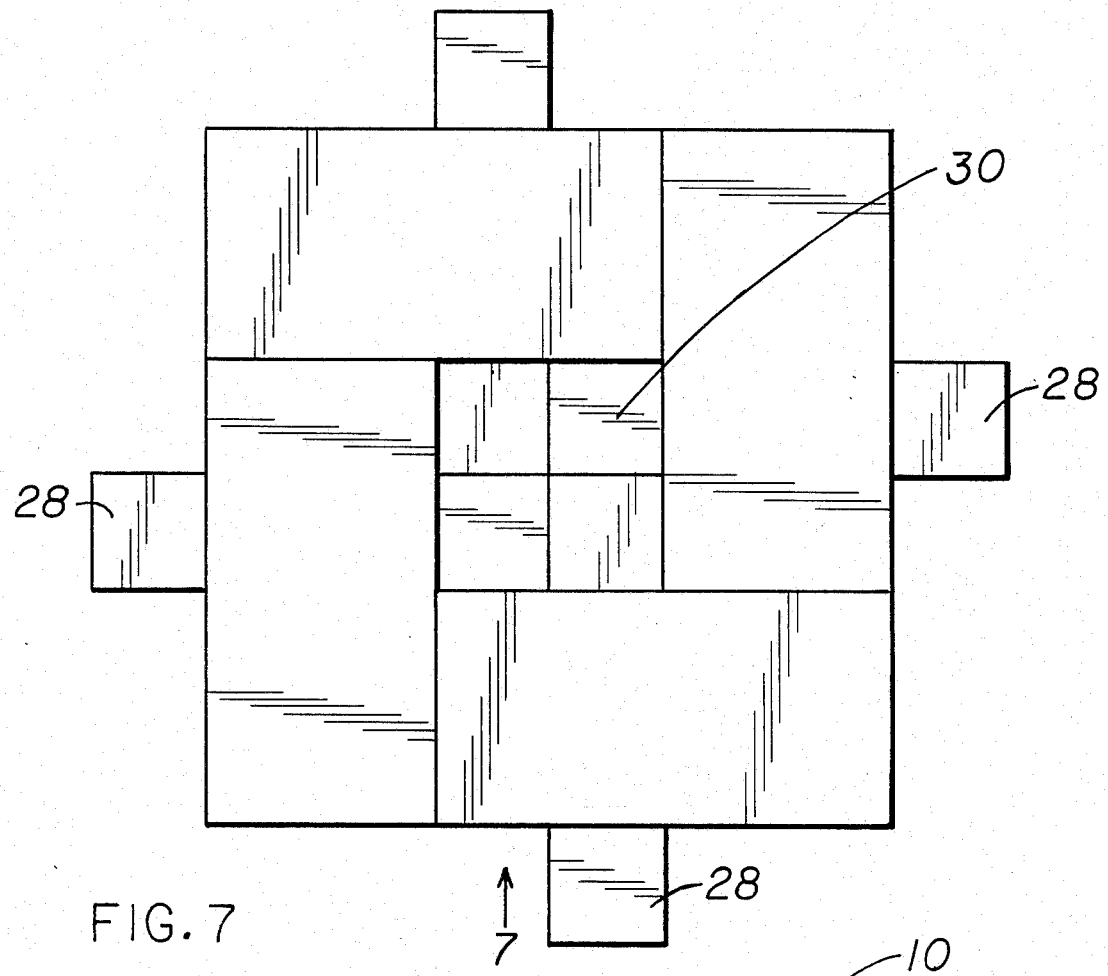
FIG. 6 is a view of four blocks joined to form a repeatable decorative pattern.
Figure 7:
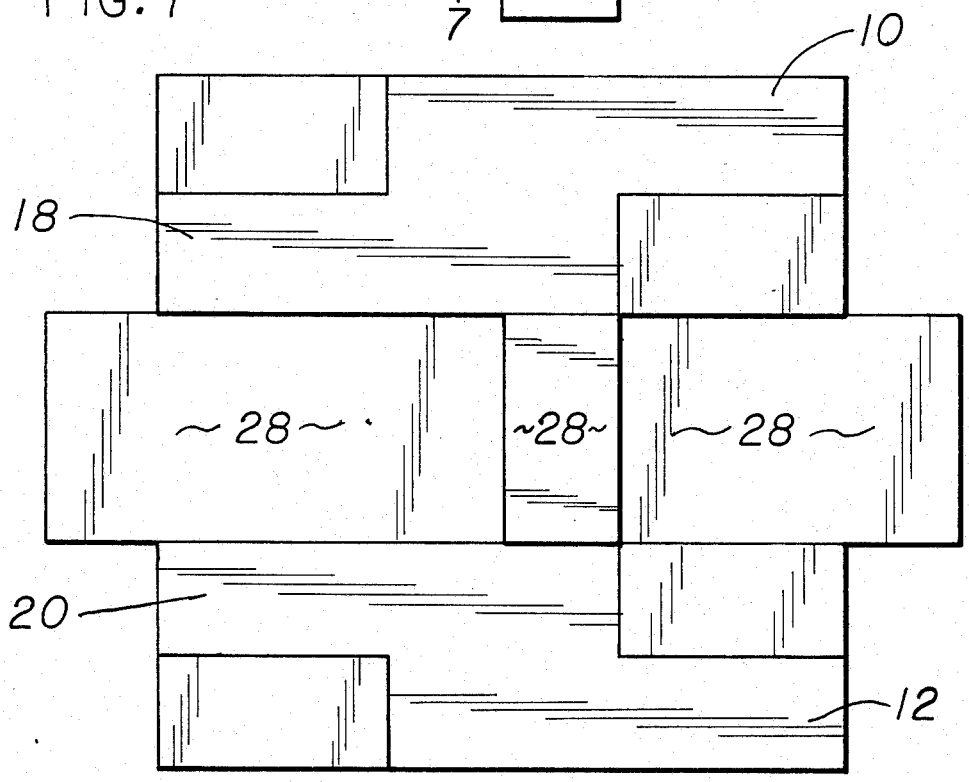
FIG. 7 is a view of the assembled blocks of FIG. 6 taken in the direction of arrow 7 in FIG. 6.

The blocks can be joined to identical blocks in a variety of patterns utilizing any of the six block faces, i.e., top, bottom, ends and sides. FIGS. 6 and 7 illustrate a decorative combination of four blocks fitted together to form a recessed center 30.

Figure 8:
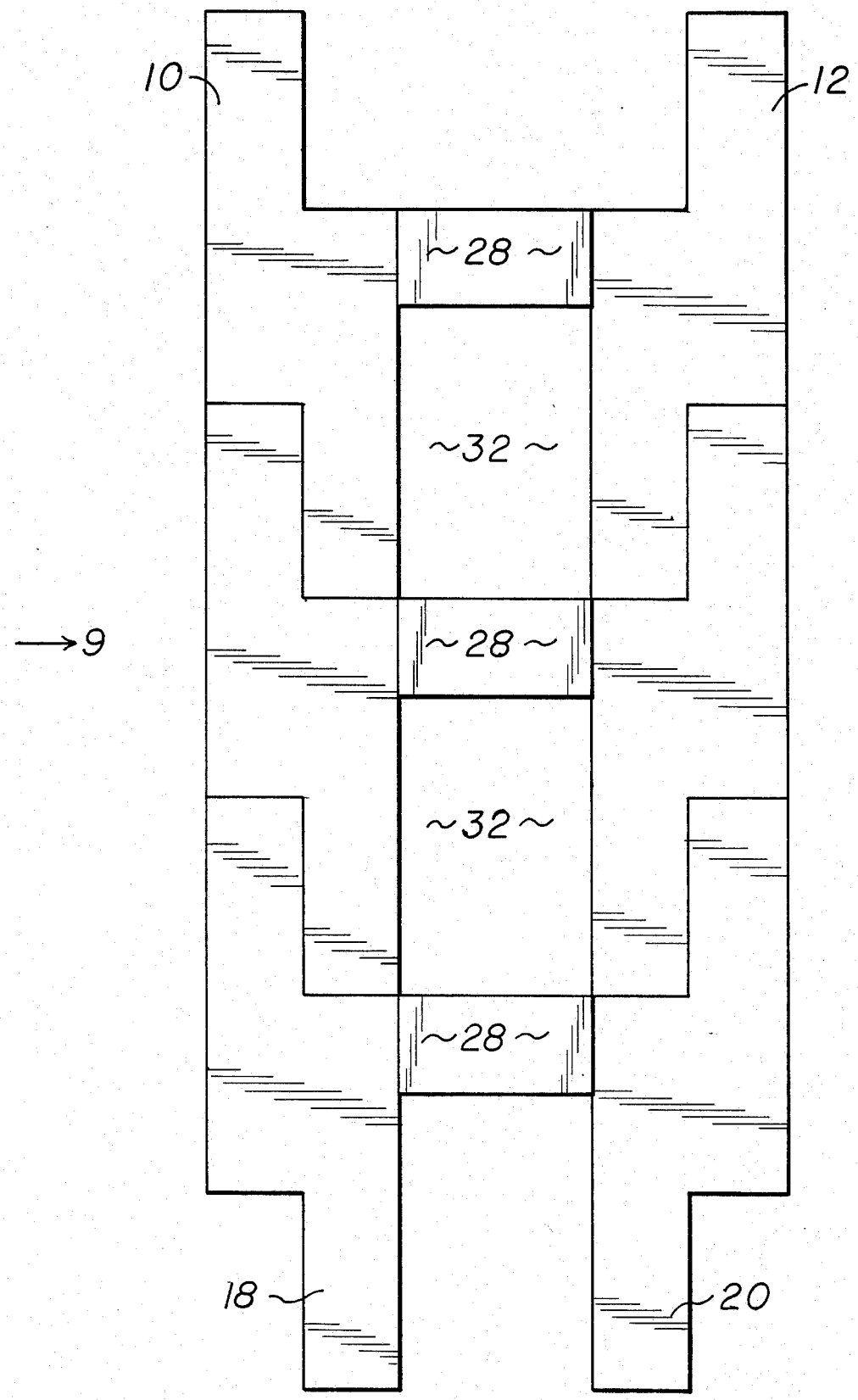
FIG. 8 illustrates a repeating block column taken in the direction of arrow 8 in FIG. 9.
Figure 9:
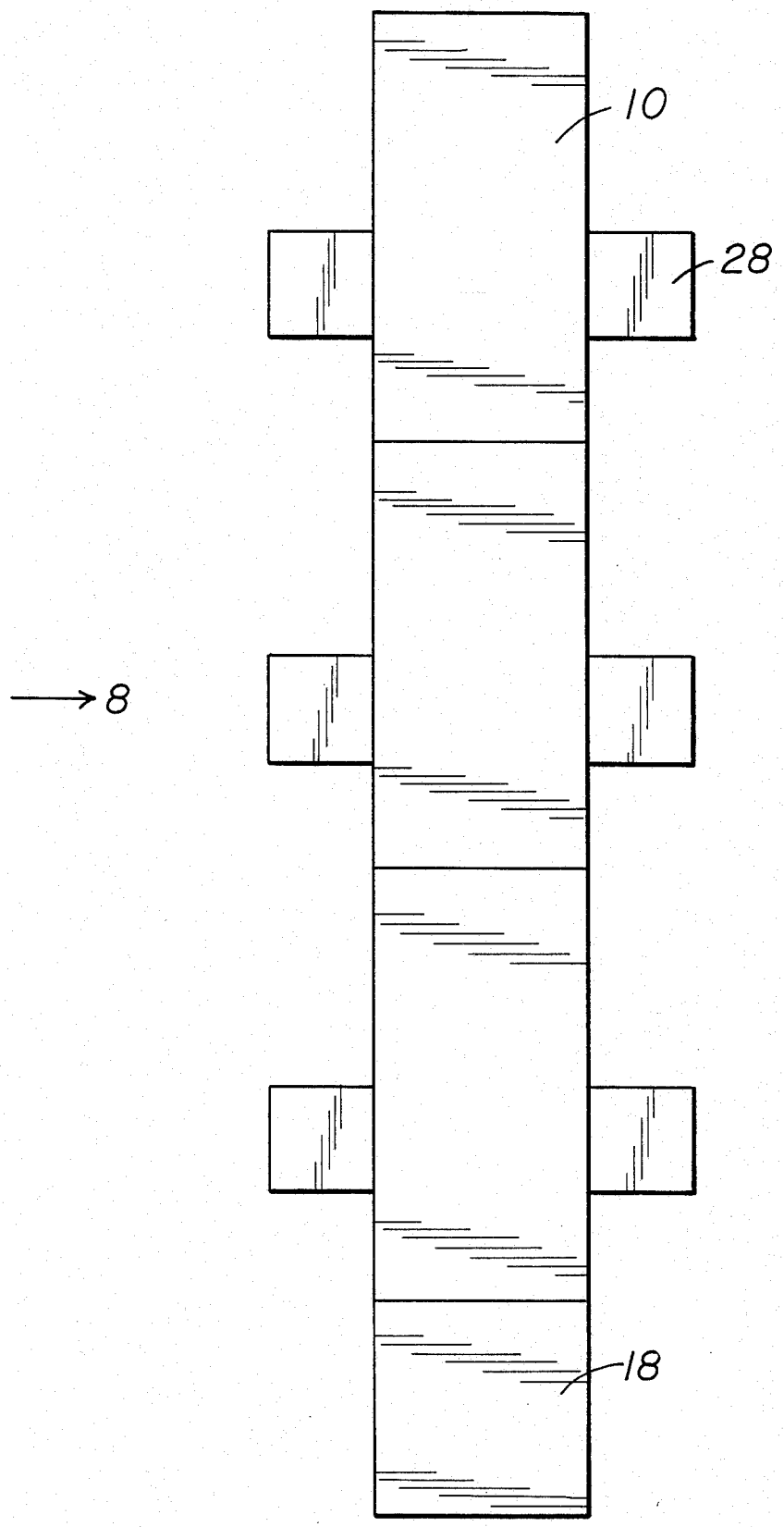
FIG. 9 illustrates the repeating block column of FIG. 8 taken in the direction of arrow 9 in FIG. 8.

FIGS. 8 and 9 illustrate a ladder column wherein the blocks are stacked to form a very stable structural column with openings 32 extending therethrough between the cross-pieces 28.

FIGS. 6 through 9 illustrate two simple combinations of the blocks, however, the possible combinations for aesthetic, structural or both purposes are limited only by the creative ability of the constructor or designer.

The blocks may be temporarily or permanently fastened together by any conventional adhesive or other fastening means depending upon the block material. Where the blocks are mortared together, the dimensions of the blocks are reduced slightly to accommodate the thickness of the mortar, typically about ⅜" to ½" in thickness. Where the blocks are of wood, plastic or metal, they may be sized for a slight interference fit enabling the structures to be assembled without fastening means. The slight interference fit is of use for trying out a variety of different block patterns before permanent assembly or for toy block sets.

I claim:

1. A generally H-shaped construction block comprising two opposed vertical portions each having a top and a bottom and joined by a horizontal central portion between the tops and bottoms, said horizontal portion having two longer parallel vertical sides and two shorter parallel vertical sides, said junctures centered on the longer vertical sides of the horizontal portion, said horizontal portion located substantially intermediate the tops and bottoms of the vertical portions and extending beyond both sides of the vertical portions and said longer vertical sides of the horizontal portion substantially equal to the distance between the tops of the vertical portions, and said shorter vertical sides of the horizontal portion substantially equal to the distance between the bottoms of the vertical portions.

2. The construction block of claim 1 wherein the block is symmetric about a vertical plane bisecting both vertical portions of the block and is symmetric about a second vertical plane equidistant from the vertical portions and perpendicular to the first vertical plane.

3. The construction block of claim 1 wherein the exterior width of the base of the block substantially equals the distance between the vertical portions at the top of the block.

4. The construction block of claim 1 wherein the distance between the vertical portions of the block below the horizontal portion substantially equals the depth of the vertical portions.

5. The construction block of claim 1 wherein the central horizontal portion of the block extends beyond the vertical portions of the block one-half the depth of the vertical portions on each side of the blocks.

6. The construction block of claim 1 wherein the vertical thickness of the central horizontal portion of the block is one-half the thickness of the vertical portions of the block immediately adjacent thereto.

7. The construction block of claim 1 wherein all horizontal and vertical dimensions of the block are integer multiples of the thickness of the horizontal portion of the block in the proportions of 1:2:4.

8. The construction block of claim 1 wherein all horizontal and vertical dimensions of the block including recesses and slots therethrough are integer multiples of the thickness of the central horizontal portion of the block in the proportions of 1:2:4.

9. An assembly of blocks comprising a plurality of the blocks as claimed in claim 1 assembled in interlocking relationships to one another to form a structure.

10. A generally H-shaped construction block comprising two opposed vertical portions each having a top and a bottom and joined by a horizontal central portion between the tops and bottoms, said horizontal portion having two longer parallel vertical sides and two shorter parallel vertical sides, said junctures centered on the longer vertical sides of the horizontal portion, said horizontal portion located substantially intermediate the tops and bottoms of the vertical portions and extending beyond both sides of the vertical portions, wherein all horizontal and vertical dimensions of the block including recesses and slots therethrough are integer multiples of the thickness of the central horizontal portion of the block and wherein at least two identical abutting blocks per face may be positively engaged with any combination of up to all six faces of the block simultaneously.

11. The construction block of claim 10 wherein the central horizontal portion of the block extends beyond the vertical portions of the block a distance equal to the vertical thickness of the central horizontal portion of the block.

12. The construction block of claim 10 wherein the slot between the lower vertical portions of the block is in width one-half the width of the slot between the upper vertical portions of the block.

13. An assembly of blocks comprising a plurality of the blocks as claimed in claim 10 interlockingly assembled to one another to form a structure.

14. A generally H-shaped construction block comprising two opposed vertical portions each having a top and a bottom and joined by a horizontal central portion between the tops and bottoms, said horizontal portion having two longer parallel vertical sides and two shorter parallel vertical sides, said junctures centered on the longer vertical sides of the horizontal portion, said horizontal portion located substantially intermediate the tops and bottoms of the vertical portions and extending beyond both sides of the vertical portions, wherein all horizontal and vertical dimensions of the block including recesses and slots therethrough are integer multiples of the thickness of the thinnest solid portion of the block and wherein at least two identical abutting blocks per face may be positively engaged with any combination of up to all six faces of the block simultaneously.

15. An assembly of blocks comprising a plurality of the blocks claimed in claim 14 interlockingly assembled to one another to form a structure.

16. A generally H-shaped construction block comprising an assemblage of five identical rectangular parallelpiped shapes each having a thickness to width to length ratio of 1:2:4 and faces of three sizes thereby, a first pair of shapes having one of the largest faces on each shape overlapped to form one vertical side of the H-shaped block, a second pair of shapes spaced from the first pair of shapes and having one of the largest faces on each shape overlapped to form the other vertical side of the H-shaped block, wherein each pair of shapes is symmetric to the other about a vertical plane equidistant therebetween, the fifth shape comprising the cross-piece of the H-shaped block joining the vertical sides together, the junctures of the fifth shape with the vertical sides being centered on the intermediate sized faces of the fifth shape and the largest face of one of each of the pair of shapes forming the vertical sides.

* * * * *